US009761169B2

(12) United States Patent
Park et al.

(10) Patent No.: US 9,761,169 B2
(45) Date of Patent: Sep. 12, 2017

(54) ORGANIC LIGHT-EMITTING DIODE DISPLAY

(71) Applicant: Samsung Display Co., Ltd., Yongin, Gyeonggi-Do (KR)

(72) Inventors: Jung-Kook Park, Cheonan-si (KR); Si-Beak Pyo, Cheonan-si (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 55 days.

(21) Appl. No.: 14/693,803

(22) Filed: Apr. 22, 2015

(65) Prior Publication Data

US 2015/0364076 A1 Dec. 17, 2015

(30) Foreign Application Priority Data

Jun. 12, 2014 (KR) ..... 10-2014-0071640

(51) Int. Cl.
*G09G 3/14* (2006.01)
*G09G 3/20* (2006.01)
(Continued)

(52) U.S. Cl.
CPC ..... *G09G 3/2081* (2013.01); *G09G 3/3233* (2013.01); *G09G 3/2014* (2013.01); *G09G 3/3208* (2013.01); *G09G 2300/0814* (2013.01); *G09G 2300/0842* (2013.01); *G09G 2300/0861* (2013.01); *G09G 2300/0866* (2013.01); *G09G 2310/0254* (2013.01); *G09G 2310/0256* (2013.01); *G09G 2310/0262* (2013.01);
(Continued)

(58) Field of Classification Search
CPC .. G09G 3/2014; G09G 3/2081; G09G 3/3208; G09G 3/3233; G09G 2300/0866; G09G 2310/0254; G09G 2310/0256
See application file for complete search history.

(56) References Cited

U.S. PATENT DOCUMENTS 6,262,704 B1 * 7/2001 Kurumisawa ..... G09G 3/3622 345/100
6,504,489 B1 * 1/2003 Westfield ..... G08C 19/02 340/870.3
(Continued)

FOREIGN PATENT DOCUMENTS

KR 10-2006-0027027 A 3/2006
KR 10-2008-0001796 A 1/2008
(Continued)

*Primary Examiner* — Michael J Eurice
(74) *Attorney, Agent, or Firm* — Knobbe Martens Olson & Bear LLP

(57) ABSTRACT

An organic light-emitting diode display is disclosed. In one aspect, the display includes a display panel including a plurality of pixels, a scan driver configured to provide a scan signal to the pixels, and a data driver configured to provide a data signal to the pixels. The display also includes a power supply configured to provide first and second power voltages, respectively having first and second voltage levels, to the pixels, wherein the power supply is further configured to substantially periodically change the second voltage level, and wherein the second voltage level is less than the first voltage level. The display also includes a controller configured to control at least one of the scan driver, the data driver, and the power supply.

19 Claims, 8 Drawing Sheets

(51) Int. Cl.

| | |
|---|---|
| ***G09G 3/30*** | (2006.01) |
| ***G09G 3/32*** | (2016.01) |
| ***G09G 3/3233*** | (2016.01) |
| *G09G 3/3208* | (2016.01) |

(52) U.S. Cl.
CPC ..... *G09G 2320/0233* (2013.01); *G09G 2320/0257* (2013.01); *G09G 2320/0271* (2013.01); *G09G 2320/0285* (2013.01); *G09G 2320/045* (2013.01); *G09G 2320/048* (2013.01); *G09G 2320/064* (2013.01); *G09G 2320/0633* (2013.01); *G09G 2320/0693* (2013.01); *G09G 2330/028* (2013.01)

(56) References Cited

U.S. PATENT DOCUMENTS

2002/0125831 A1* 9/2002 Inukai ..... G09G 3/3266 315/169.3
2002/0190326 A1* 12/2002 Nagao ..... G09G 3/3648 257/359
2002/0195968 A1* 12/2002 Sanford ..... G09G 3/325 315/169.3
2002/0196213 A1* 12/2002 Akimoto ..... G09G 3/3258 345/82
2003/0090447 A1* 5/2003 Kimura ..... G09G 3/3241 345/82
2004/0075627 A1* 4/2004 Ouchi ..... G09G 3/3233 345/76
2004/0090186 A1* 5/2004 Yoshida ..... G09G 3/3233 315/169.1
2004/0183583 A1* 9/2004 Mizuno ..... H03K 17/693 327/389
2005/0184952 A1* 8/2005 Konno ..... G09G 3/3426 345/102
2005/0225683 A1* 10/2005 Nozawa ..... G09G 3/2014 348/801
2006/0022305 A1* 2/2006 Yamashita ..... G09G 3/2014 257/565
2006/0256057 A1* 11/2006 Han ..... G09G 3/3258 345/92
2007/0018925 A1* 1/2007 Cheng ..... G09G 3/2014 345/92
2007/0030222 A1* 2/2007 Lee ..... G09G 3/3406 345/87
2007/0035498 A1* 2/2007 Jeon ..... G09G 3/2025 345/92
2007/0063959 A1* 3/2007 Iwabuchi ..... G09G 3/2074 345/100
2007/0063993 A1* 3/2007 Shishido ..... G09G 3/3241 345/175
2007/0085847 A1* 4/2007 Shishido ..... G09G 3/3233 345/204
2007/0091029 A1* 4/2007 Uchino ..... G09G 3/3233 345/76
2007/0146336 A1* 6/2007 Ording ..... G06F 3/04886 345/173
2007/0166869 A1* 7/2007 Cheng ..... G09G 3/2014 438/82
2008/0001857 A1* 1/2008 Yoo ..... G09G 3/3233 345/76
2008/0007547 A1* 1/2008 Hasumi ..... G09G 3/3233 345/211
2008/0129660 A1* 6/2008 Iida ..... G09G 3/3233 345/80
2008/0252570 A1* 10/2008 Kwon ..... G09G 3/3233 345/76
2008/0272999 A1* 11/2008 Kurokawa ..... G09G 3/3406 345/89
2009/0051628 A1* 2/2009 Kwon ..... G09G 3/3233 345/77
2009/0079724 A1 3/2009 Dou
2009/0141202 A1* 6/2009 Yoshida ..... G09G 3/3233 349/38
2009/0201231 A1* 8/2009 Takahara ..... G09G 3/3233 345/76
2010/0079419 A1* 4/2010 Shibusawa ..... H01L 27/3272 345/204
2010/0109540 A1* 5/2010 Kim ..... G09G 3/3225 315/210
2010/0231562 A1* 9/2010 Brown ..... G06F 3/0412 345/207
2011/0007102 A1* 1/2011 Ogura ..... G09G 3/3233 345/690
2011/0074762 A1* 3/2011 Shirasaki ..... G09G 3/3225 345/211
2011/0084893 A1* 4/2011 Lee ..... G06F 1/1649 345/6
2011/0149180 A1* 6/2011 Ichioka ..... G09G 3/3611 348/836
2012/0062545 A1* 3/2012 Kim ..... G09G 3/3233 345/212
2013/0050292 A1* 2/2013 Mizukoshi ..... G09G 3/3291 345/690
2013/0099692 A1* 4/2013 Chaji ..... H05B 37/02 315/224
2013/0100173 A1* 4/2013 Chaji ..... G09G 5/10 345/690
2014/0078028 A1* 3/2014 Qing ..... G09G 3/3233 345/77
2014/0111563 A1* 4/2014 Hwang ..... H04N 13/0438 345/691
2014/0139505 A1* 5/2014 Han ..... H04N 13/0438 345/212
2014/0139566 A1* 5/2014 Han ..... G09G 5/10 345/691
2014/0320425 A1* 10/2014 Jeong ..... G06F 3/1454 345/173
2014/0347401 A1* 11/2014 Hwang ..... G09G 3/3233 345/690
2015/0154913 A1* 6/2015 Kim ..... G09G 3/3233 345/691

FOREIGN PATENT DOCUMENTS

KR 10-2009-0031971 A 3/2009
KR 10-2011-0085399 A 7/2011

* cited by examiner

ORGANIC LIGHT-EMITTING DIODE DISPLAY

CROSS-REFERENCE TO RELATED APPLICATIONS

This application claims priority under 35 U.S.C. §119 to Korean patent Application No. 10-2014-0071640 filed on Jun. 12, 2014, the disclosure of which is hereby incorporated by reference herein in its entirety.

BACKGROUND

Field

The described technology generally relates to an organic light-emitting diode display.

Description of the Related Technology

An organic light-emitting diode (OLED) includes an organic layer between an anode electrode and a cathode electrode. Positive holes from the anode electrode can be combined with electrons from the cathode electrode in the organic layer to emit light. OLED technologies have a variety of favorable characteristics such as wide viewing angles, rapid response speeds, relatively thin profiles, and low power consumption.

SUMMARY OF CERTAIN INVENTIVE ASPECTS

One inventive aspect is an OLED display that can reduce occurrence of afterimages.

Another aspect is an OLED display that includes a display panel including a plurality of pixels, a scan driver configured to provide a scan signal to the pixels, a data driver configured to provide a data signal to the pixels, a power supply configured to provide a first power voltage having a first voltage level and a second power voltage having a second voltage level that is periodically changed to the pixels, the second voltage level being lower than the first voltage level, and a controller configured to control at least one selected among the scan driver, the data driver, and the power supply.

In example embodiments, the second voltage level is changed in a range between a first reference voltage level and an (N)th reference voltage level, where N is an integer greater than 1. An (M)th reference voltage level can be greater than an (M−1)th reference voltage level, where M is an integer between 2 and N.

In example embodiments, the second voltage level is increased from the first reference voltage level to the (N)th reference voltage level in a first period. The second voltage level can be decreased from the (N)th reference voltage level to the first reference voltage level in a second period.

In example embodiments, the second voltage level is increased by a unit of frame period in the first period. The second voltage level can be decreased by a unit of frame period in the second period.

In example embodiments, the first through (N)th reference voltage levels have the same time length in the first period and in the second period.

In example embodiments, at least two selected among the first through (N)th reference voltage levels have a different time length from each other in the first period and in the second period.

In example embodiments, the power supply is further configured to provide an initialization voltage having a third voltage level to the pixels. The first reference voltage level can be lower than the third voltage level, and the (N)th reference voltage level can be higher than the third voltage level.

In example embodiments, the OLED display further includes an emission driver configured to provide an emission signal to the pixels. The controller can control the emission driver to adjust an on-period length of the emission signal based on the second voltage level.

In example embodiments, the controller controls the data driver to adjust the data signal based on the second voltage level.

In example embodiments, the power supply is further configured to provide an initialization voltage having a third voltage level to the pixels. The controller can control the power supply to adjust the third voltage level based on the second voltage level.

In example embodiments, the display panel is divided into a main display region and a status display region. The controller can adjust luminance of the status display region based on luminance of the main display region.

In example embodiments, the controller includes an on-pixel rate calculator configured to calculate a first on-pixel rate of the main display region and a second on-pixel rate of the status display region, a compensation value generator configured to generate a compensation value for the second on-pixel rate based on a change of the first on-pixel rate, and a luminance adjuster configured to adjust the luminance of the status display region based on the compensation value.

In example embodiments, the compensation value generator generates the compensation value for the second on-pixel rate using a look-up table (LUT)

In example embodiments, the compensation value generator generates the compensation value for the second on-pixel rate using a predetermined ratio of the luminance of the status display region to the luminance of the main display region.

In example embodiments, the luminance adjuster controls the data driver to adjust the data signal based on the compensation value.

In example embodiments, the OLED display further includes an emission driver configured to provide an emission signal to the pixels. The luminance adjuster can control the emission driver to adjust an on-period length of the emission signal based on the compensation value.

In example embodiments, the power supply is further configured to provide an initialization voltage having a third voltage level to the pixels. The luminance adjuster can control the power supply to adjust the third voltage level based on the compensation value.

Another aspect is an OLED display that includes a display panel including a plurality of pixels located on a main display region and a status display region, the display panel being divided into the main display region and the status display region, a scan driver configured to provide a scan signal to the pixels, a data driver configured to provide a data signal to the pixels, a power supply configured to provide a first power voltage having a first voltage level and a second power voltage having a second voltage level lower than the first voltage level to the pixels, and a controller configured to control at least one selected among the scan driver, the data driver, and the power supply and configured to adjust luminance of the status display region based on luminance of the main display region.

In example embodiments, the controller includes an on-pixel rate calculator configured to calculate a first on-pixel rate of the main display region and a second on-pixel rate of the status display region, a compensation value generator configured to generate a compensation value for the second on-pixel rate based on a change of the first on-pixel rate, and a luminance adjuster configured to adjust the luminance of the status display region based on the compensation value.

In example embodiments, the compensation value generator generates the compensation value for the second on-pixel rate using a look-up table (LUT).

Another aspect is an organic light-emitting diode (OLED) display, comprising a display panel including a plurality of pixels, a scan driver configured to provide a scan signal to the pixels, and a data driver configured to provide a data signal to the pixels. The display also comprises a power supply configured to provide first and second power voltages, respectively having first and second voltage levels, to the pixels, wherein the power supply is further configured to substantially periodically change the second voltage level, and wherein the second voltage level is less than the first voltage level. The display also includes a controller configured to control at least one of the scan driver, the data driver, and the power supply.

In the above display, the power supply is further configured to change the second voltage level to be within a range between a first reference voltage level and an (N)th reference voltage level, wherein N is an integer greater than 1, wherein an (M)th reference voltage level is greater than an (M−1)th reference voltage level, and wherein M is an integer between 2 and N.

In the above display, the power supply is further configured to increase the second voltage level from the first reference voltage level to the (N)th reference voltage level in a first period, wherein the power supply is further configured to decrease the second voltage level from the (N)th reference voltage level to the first reference voltage level in a second period.

In the above display, the power supply is further configured to increase the second voltage level by a unit of frame period in the first period, wherein the power supply is further configured to decrease the second voltage level by a unit of frame period in the second period.

In the above display, the first through (N)th reference voltage levels have substantially the same time length in the first and second periods.

In the above display, at least two of the first through (N)th reference voltage levels have a different time length from each other in the first and second periods.

In the above display, the power supply is further configured to provide an initialization voltage having a third voltage level to the pixels, wherein the first reference voltage level is less than the third voltage level, and wherein the (N)th reference voltage level is greater than the third voltage level.

The above display further comprises an emission driver configured to provide an emission signal to the pixels, wherein the controller is further configured to control the emission driver to adjust an on-period length of the emission signal based at least in part on the second voltage level.

In the above display, the controller is further configured to control the data driver to adjust the data signal based at least in part on the second voltage level.

In the above display, the power supply is further configured to provide an initialization voltage having a third voltage level to the pixels, wherein the controller is further configured to control the power supply to adjust the third voltage level based at least in part on the second voltage level.

In the above display, the display panel includes a main display region having a first luminance and a status display region having a second luminance, wherein the controller is further configured to adjust the second luminance based at least in part on the first luminance.

In the above display, the controller includes an on-pixel rate calculator configured to calculate a first on-pixel rate of the main display region and a second on-pixel rate of the status display region, a compensation value generator configured to generate a compensation value for the second on-pixel rate based at least in part on a change of the first on-pixel rate, and a luminance adjuster configured to adjust the first luminance based at least in part on the compensation value.

In the above display, the compensation value generator is further configured to generate the compensation value for the second on-pixel rate based at least in part on a look-up table (LUT).

In the above display, the compensation value generator is further configured to generate the compensation value for the second on-pixel rate based at least in part on a predetermined ratio of the second luminance to the first luminance.

In the above display, the luminance adjuster is further configured to control the data driver to adjust the data signal based at least in part on the compensation value.

The above display further comprises an emission driver configured to provide an emission signal to the pixels, wherein the luminance adjuster is further configured to control the emission driver to adjust an on-period length of the emission signal based at least in part on the compensation value.

In the above display, the power supply is further configured to provide an initialization voltage having a third voltage level to the pixels, wherein the luminance adjuster is further configured to control the power supply to adjust the third voltage level based at least in part on the compensation value.

Another aspect is an organic light-emitting diode (OLED) display comprising a display panel including a plurality of pixels in a main display region having a first luminance and a status display region having a second luminance, a scan driver configured to provide a scan signal to the pixels, and a data driver configured to provide a data signal to the pixels. The display also comprises a power supply configured to provide first and second power voltages, respectively having first and second voltage levels, to the pixels, wherein the second voltage level is less than the first voltage level. The display further comprises a controller configured to i) control at least one of the scan driver, the data driver, and the power supply and ii) adjust the second luminance based at least in part on the first luminance.

In the above display, the controller includes an on-pixel rate calculator configured to calculate a first on-pixel rate of the main display region and a second on-pixel rate of the status display region, a compensation value generator configured to generate a compensation value for the second on-pixel rate based at least in part on a change of the first on-pixel rate, and a luminance adjuster configured to adjust the second luminance based at least in part on the compensation value.

In the above display, the compensation value generator is configured to generate the compensation value for the second on-pixel rate based at least in part on a look-up table (LUT).

According to at least one of the disclosed embodiments, an OLED display periodically changes the second voltage level of the second power voltage to reduce a load of the OLED and prevent a deterioration of the OLED. The OLED display reduces the occurrence of afterimage and has a long life span.

In addition, the OLED display adjusts luminance of a status display region based on luminance of a main display region to prevent the occurrence of afterimage in the status display region.

DETAILED DESCRIPTION OF CERTAIN INVENTIVE EMBODIMENTS

Generally, first and second power voltages are respectively applied to the anode and cathode electrodes of an OLED. Because the first power voltage is higher than the second power voltage, negative carriers (e.g., the electrons) are positioned near the cathode electrode and positive carriers (e.g., the holes) are positioned near the anode electrode. When the negative and positive carriers are positioned near the electrodes for a long time, movement of the holes and the electrons decreases which can decrease light emission. Therefore, the luminance of the OLED can be decreased and an afterimage can appear.

Exemplary embodiments will be described more fully hereinafter with reference to the accompanying drawings, in which various embodiments are shown. In this disclosure, the term "substantially" includes the meanings of completely, almost completely or to any significant degree under some applications and in accordance with those skilled in the art. Moreover, "formed on" can also mean "formed over." The term "connected" can include an electrical connection.

Figure 1:
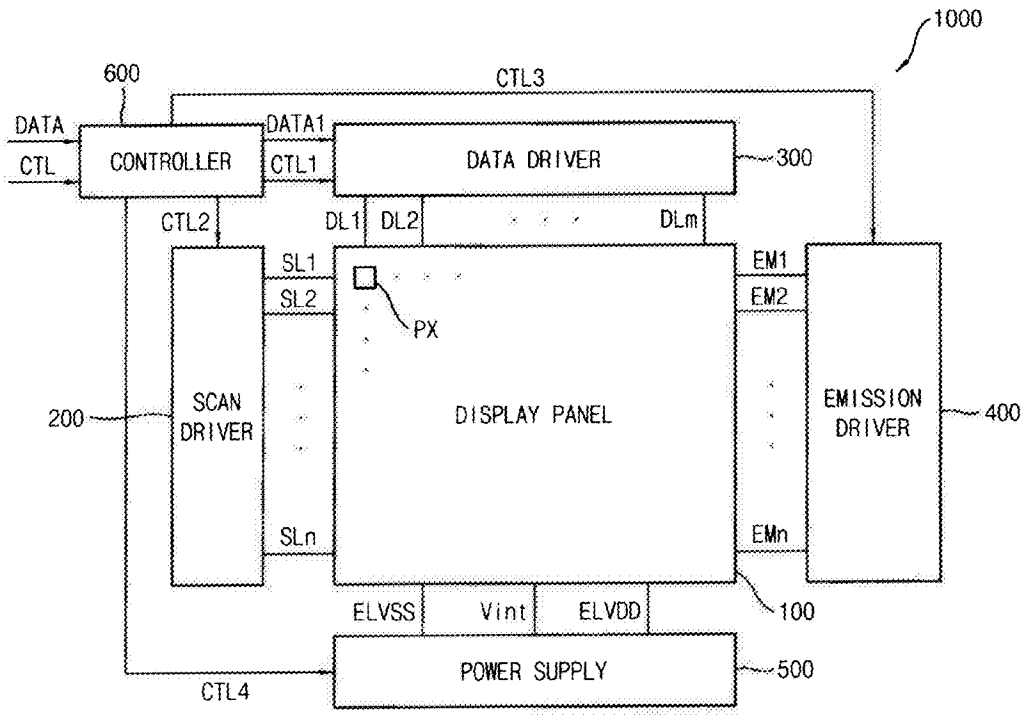
FIG. 1 is a block diagram illustrating an OLED display according to example embodiments.

FIG. 1 is a block diagram illustrating an OLED display according to example embodiments.

Referring to FIG. 1, the OLED display 1000 includes a display panel 100, a scan driver 200, a data driver 300, an emission driver 400, a power supply 500, and a controller 600.

The display panel 100 includes a plurality of pixels PX. The display panel 100 can be connected to the scan driver 200 via a plurality of scan lines SL1 through SLn. The display panel 100 can be connected to the data driver 300 via a plurality of data lines DL1 through DLm. The display panel 100 can be connected to the emission driver 400 via a plurality of emission lines EM1 through EMm. The display panel 100 can include n*m pixels PX because the pixels PX are arranged at locations corresponding to crossing points of the scan lines SL1 through SLn and the data-lines DL1 through DLm. In some embodiments, the display panel 100 includes a main display region in which main data of image data are displayed and a status display region in which subsidiary data of the image data such as status information of the display device are displayed. For example, the main display region and the status display region can be divided by the controller 600.

The scan driver 200 can provide scan signals to the pixels PX via the scan lines SL1 through SLm.

The data driver 300 can provide data signals to the pixels PX via the data lines DL1 through DLm.

The emission driver 400 can provide emission signals to the pixels PX via the emission lines EM1 through EMn.

The power supply 500 can provide a first power voltage ELVDD having a first voltage level and a second power voltage ELVSS having a second voltage level. For example, the first power voltage ELVDD is a high power voltage and the second power voltage ELVSS is a low power voltage. The second voltage level can be substantially periodically changed and the second voltage level can be less than the first voltage level. The second voltage level can be changed within a range between a first reference voltage level and an (N)th reference voltage level, where N is an integer greater than 1. An (M)th reference voltage level is greater than an (M−1)th reference voltage level, where M is an integer between 2 and N. In some embodiments, the power supply 500 further provides an initialization voltage Vint having a third voltage level to the pixels PX. The initialization voltage Vint can be applied to the pixels PX during predetermined initialization period of frame, thereby initializing the pixels PX.

In some embodiments, the first reference voltage level is less than the third voltage level. Also, the (N)th reference voltage level can be greater than the third voltage level. Thus, the second voltage level of the second power voltage ELVSS can be greater than the third voltage level of the initialization voltage in portions of the first period and the second period such that the OLED has the reverse bias during initialization period of frame. When the OLED has the reverse bias, impurities in the OELD can be removed, thereby preventing decrease of movement of holes and electrons for emitting the light.

The controller 600 can control at least one selected among the scan driver 200, the data driver 300, the emission driver 400 and the power supply 500. The controller 600 can receive an input control signal CTL and an input image data DATA from an image source such as an external graphic device. The input control signal CTL can include a master clock signal, a vertical synchronization signal, a horizontal synchronization signal, and a data enable signal, etc. In addition, the controller 600 can generate an output image data DATA1 and a plurality of timing control signals CTL1 through CTL4. The controller 600 can provide the output image data DATA1 and the timing control signals CTL1 through CTL4 to the scan driver 200, the data driver 300, the emission driver 400, and the power supply 500 for controlling thereof.

The controller 600 can control the data driver 300, the emission driver 400, and the power supply 500 to prevent a change of luminance by changing the second voltage level of the second power voltage ELVSS. In some embodiments, the controller 600 controls the emission driver 400 to adjust an on-period length of the emission signal 400 based at least in part on the second voltage level. Thus, the controller 600 can adjust emission time of the OLED to prevent the change of luminance. In some embodiments, the controller 600 controls the data driver 300 to adjust the data signal based at least in part on the second voltage level. Thus, the controller 600 can adjust the output image data DATA1, gamma reference voltage, etc. based at least in part on the second voltage level, thereby preventing the change of luminance. In some embodiments, the controller 600 controls the power supply 500 to adjust the third voltage level of the initialization voltage Vint based at least in part on the second voltage level. Thus, the controller 600 can adjust the third voltage level of the initialization voltage Vint to adjust a voltage of a storage capacitor included in the pixel circuit, thereby preventing the change of luminance.

In addition, the controller 600 can adjust luminance of the status display region based at least in part on luminance of the main display region to reduce the occurrence of afterimage in the status display region. The controller 600 can calculate a first on-pixel rate of the main display region and a second on-pixel rate of the status display region. The controller 600 can generate a compensation value for the second on-pixel rate based at least in part on a change of the first on-pixel rate. The controller 600 can adjust the luminance of the status display region based at least in part on the compensation value. In some embodiments, the controller 600 generates the compensation value for the second on-pixel rate using a look-up table (LUT). In embodiments, the controller 600 generates the compensation value for the second on-pixel rate using a predetermined ratio of the luminance of the status display region to the luminance of the main display region.

Therefore, the OLED display 1000 can substantially periodically change the second power voltage ELVSS to reduce a load of the OLED and prevent a deterioration of the OLED. In addition, the OLED display 1000 can adjust luminance of the status display region based at least in part on luminance of the main display region to reduce the occurrence of an afterimage in the status display region.

Figure 2:
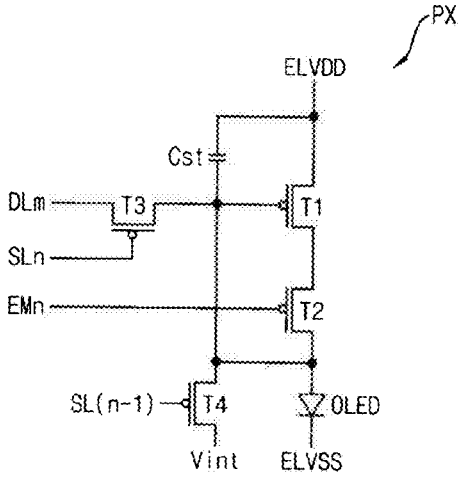
FIG. 2 is a circuit diagram illustrating an example of a pixel circuit included in the OLED display of FIG. 1.

FIG. 2 is a circuit diagram illustrating an example of a pixel circuit included in the OLED display of FIG. 1.

Referring to FIG. 2, the pixel circuit included in the pixel PX includes first through fourth transistor T1 through T4 and a storage capacitor Cst.

The first transistor T1 can be a driving transistor. The first transistor T1 can be connected between a first power voltage ELVDD and an OLED. A gate electrode of the first transistor T1 can be connected to the storage capacitor Cst. The first transistor T1 can adjust a driving current flowing through the OLED corresponding to a voltage of the storage capacitor Cst. The OLED can emit the light based at least in part on amount of the driving current provided from the first transistor T1.

The second transistor T2 can be connected between a drain electrode of the first transistor T1 and the OLED. A gate electrode of the second transistor T2 can be connected to an emission line EMn.

The third transistor T3 can include a first electrode connected to the data line DLm, a second electrode connected to the gate electrode of the first transistor T1 and the storage capacitor Cst, and a gate electrode connected to a scan line SLn. The third transistor T3 can be turned on when a scan signal is applied from the scan line SLn to the gate electrode of the third transistor T3, thereby providing a data signal from the data line DLm to the storage capacitor Cst.

The fourth transistor T4 can include a first electrode where the initialization voltage Vint is applied, a second electrode connected to the storage capacitor Cst and the OLED, and a gate electrode connected to the previous scan line SLn-1. The fourth transistor T4 can be turned on when a previous scan signal is applied from the previous scan line SLn to the gate electrode of the fourth transistor T4, thereby initializing the storage capacitor Cst and the OLED. The OLED can have a reverse bias or a forward bias based at least in part on the voltage difference between the second power voltage ELVSS and the initialization voltage Vint. For example, when the second power voltage ELVSS is greater than the initialization voltage Vint, the OLED has the reverse bias. Also, when the second power voltage ELVSS is lower than the initialization voltage Vint, the OLED can have the forward bias.

The storage capacitor Cst can be connected between the gate electrode and source electrode of the first transistor T1. The storage capacitor Cst can charge a threshold voltage of the first transistor T1 and voltage of the data signal.

Although the example embodiments describe that the pixel circuit includes four p-channel metal oxide semiconductor (PMOS) transistors and one capacitor, the pixel circuit can have various structures.

Figure 3:
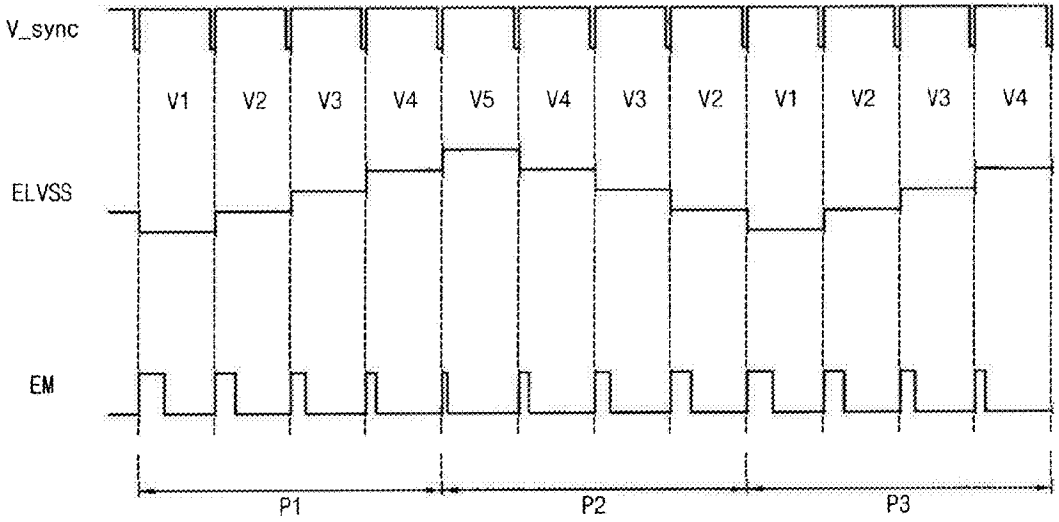
FIGS. 3 through 5 are waveforms illustrating signals applied to a pixel circuit of FIG. 2.
Figure 4:
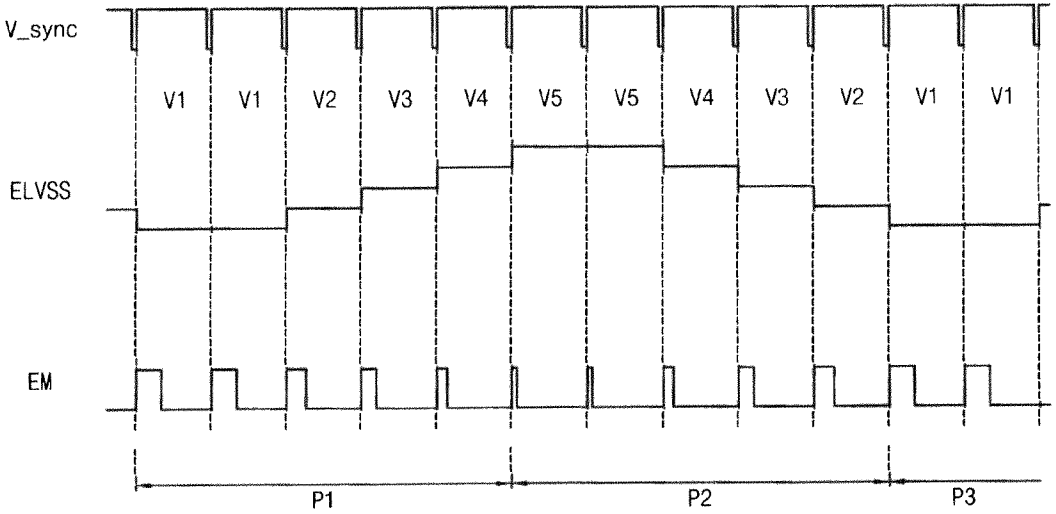
Figure 5:
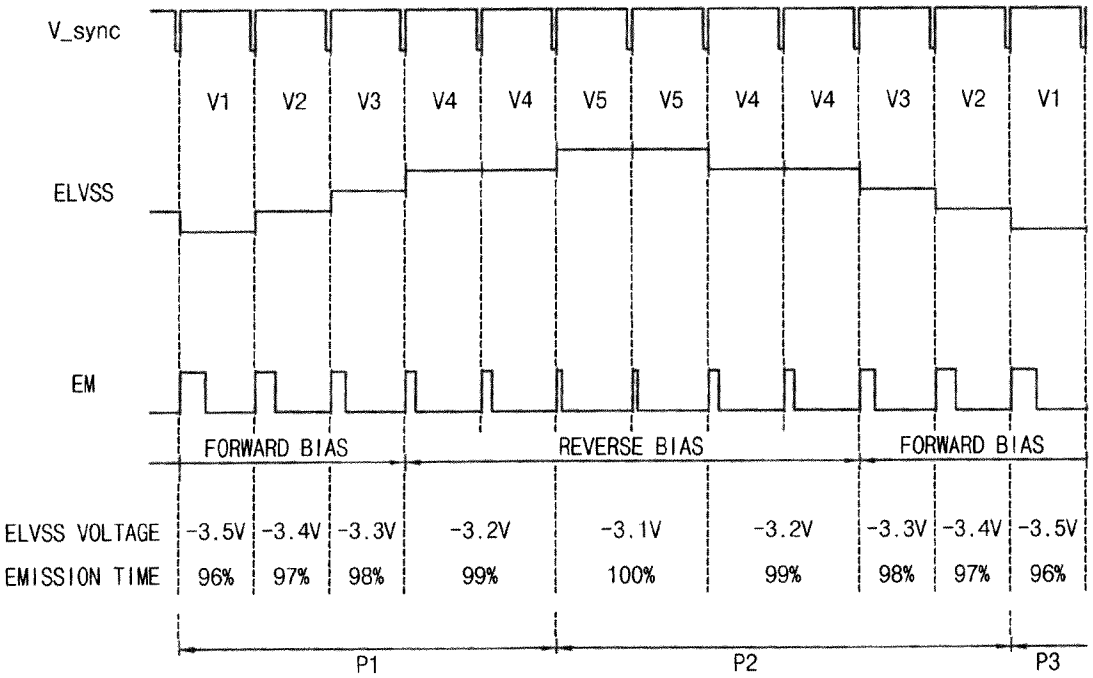

FIGS. 3 through 5 are waveforms illustrating signals applied to the pixel circuit of FIG. 2.

Referring to FIGS. 3 through 5, a second voltage level of a second power voltage ELVSS is substantially periodically changed. The second voltage level can vary within a range between a first reference voltage level and an (N)th reference voltage level, where N is an integer greater than 1. An (M)th reference voltage level is greater than an (M−1)th reference voltage level, where M is an integer between 2 and N. The second voltage level can be increased from the first reference voltage level to the (N)th reference voltage level in a first period P1 or P3. The second voltage level can be decreased from the (N)th reference voltage level to the first reference voltage level in a second period P2. Here, if a range of reference voltage levels is too broad, luminance of the OLED can be changed too much by the second voltage level. Therefore, the range of reference voltage levels can be determined with consideration of preventing the occurrence of the afterimage without changing the luminance of the OLED.

As shown in FIG. 3, the second voltage level is increased by a unit of a frame period in the first period P1 or P3. The second voltage level can be decreased by a unit of a frame period in the second period P2. Thus, the second power voltage ELVSS can be increased or decreased within the range between the first reference voltage level and the (N)th reference voltage level every frame period to reduce a load of the OLED and prevent a deterioration of the OLED. In addition, an on-period length of the emission signal EM can be adjusted based at least in part on the second voltage level to prevent change of luminance.

As shown in FIG. 4, the second voltage level is increased in the first period P1 or P3. The second voltage level can be decreased in the second period P2. The first through (N)th reference voltage levels can have substantially the same time length in the first period P1 or P3 and in the second period P2. Thus, the second voltage level of the second power voltage ELVSS can be increased or decreased within the range between the first reference voltage level and the (N)th reference voltage level of which time length are substantially the same each other, thereby reducing the load of the OLED and preventing the deterioration of the OLED. In addition, the on-period length of the emission signal EM can be adjusted based on the second voltage level to prevent the change of luminance.

As shown in FIG. 5, the first reference voltage level is lower than the third voltage level. Also, the (N)th reference voltage level can be greater than the third voltage level. Thus, the second voltage level of the second power voltage ELVSS can be greater than the third voltage level of the initialization voltage in at least a part of the first period P1 or P3 and the second period P2 such that the OLED has the reverse bias during the initialization period of the frame. For example, when the third voltage level of the initialization voltage is about −3.3V, the first reference voltage level is about −3.5V, and the (N)th reference voltage level is about −3.1V, the OLED has the forward bias while the second power voltage ELVSS is within the range between about −3.3V and about −3.5V. Also, the OLED can have the reverse bias while the second power voltage ELVSS is in the range between about −3.1V and about −3.2V. Thus, bias status of the OLED can be substantially periodically changed at the initialization period of the frame. When the OLED has the reverse bias, impurities in the OLED can be removed, thereby preventing decrease of movement of holes and electrons for emitting the light. Therefore, the OLED having the reverse bias during the initialization period of the frame can reduce the occurrence of an afterimage and the luminance degradation by deterioration of the OLED in comparison with an OLED only having the forward bias. In some embodiments, at least two selected among the first through (N)th reference voltage levels have a different time length from each other in the first period P1 or P3 and in the second period P2. For example, the second voltage level of the second power voltage ELVSS is increased or decreased every two frame periods during the reverse bias period to extend the reverse bias period.

In addition to the methods shown in FIGS. 3 through 5, the second voltage level of the second power voltage ELVSS can be changed by various methods to reduce a load of the OLED and prevent a deterioration of the OLED. If the second voltage level of the second power voltage ELVSS is maintained at a substantially constant level, negative carriers positioned near the anode electrode and the positive carriers near the cathode electrode can be maintained for a long time when the OLED display displays the still image. Therefore, hysteresis can occur in the OLED. On the other hand, if the second voltage level of the second power voltage ELVSS is substantially periodically changed, the hysteresis of the OLED can be reduced. Therefore, the occurrence of an afterimage can be reduced and the OLED display can have a longer life span.

The on-period length of the emission signal EM can be adjusted based at least in part on the second voltage level to prevent the change of luminance. When the second voltage level of the second power voltage ELVSS is increased, luminance of the OLED can be decreased. Therefore, the on-period length of the emission signal can be extended to compensate the luminance degradation. On the other hand, when the second voltage level of the second power voltage ELVSS is decreased, the luminance of the OLED can be increased. Therefore, the on-period length of the emission signal EM can be reduced to decrease the luminance of the OLED. For example, in FIG. 5, an emission ratio of a first voltage period V1 on which the second voltage level is the first reference voltage level is about 96%. The emission ratio of a second voltage period V2 on which the second voltage level is the second reference voltage level can be about 97%. The emission ratio of a third voltage period V3 on which the second voltage level is the third reference voltage level can be about 98%. The emission ratio of a fourth voltage period V4 on which the second voltage level is the fourth reference voltage level can be about 99%. The emission ratio of a fifth voltage period V5 on which the second voltage level is the fifth reference voltage level can be about 100%.

Although the example embodiments as shown in FIGS. 3 through 5 describe that the on-period length of the emission signal EM is adjusted to prevent the change of luminance, the luminance of the OLED can be maintained by various methods. For example, to prevent the change of luminance by changing the second voltage level, the third voltage level of the initialization voltage is adjusted based at least in part on the second voltage level, or the data signal is adjusted based at least in part on the second voltage.

Figure 6:
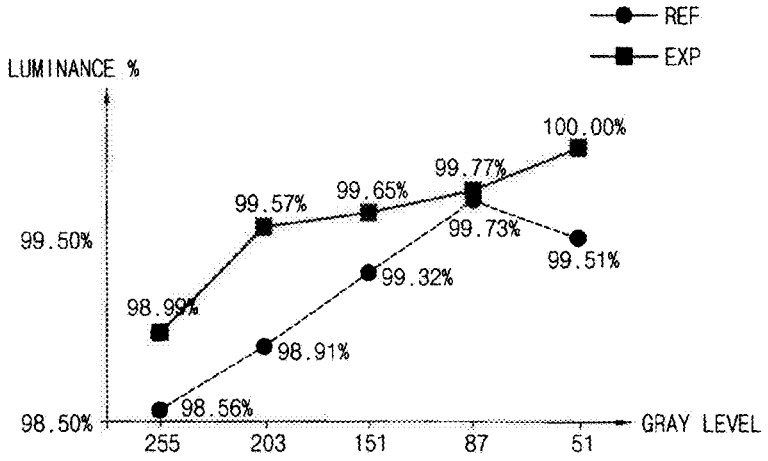
FIG. 6 is a graph illustrating an effect of the OLED display of FIG. 1.

FIG. 6 is a graph illustrating an effect of the OLED display of FIG. 1.

Referring to FIG. 6, the OLED display 1000 of FIG. 1 reduces the luminance degradation. The display panel respectively can output the data signals corresponding to 51 grayscale, 87 grayscale, 151 grayscale, 203 grayscale, and 255 grayscale during 24 hours to measure initial luminance degradation. In some embodiments, a comparative OLED display REF maintains the second voltage level of the second power voltage ELVSS as about −3.5V. Luminance of the comparative OLED display REF was maintained at about 99.51% when the data signal corresponds to the 51 grayscale. Luminance of the comparative OLED display REF was maintained at about 99.73% when the data signal corresponds to the 87 grayscale. Luminance of the comparative OLED display REF was maintained at about 99.32% when the data signal corresponds to the 151 grayscale. Luminance of the comparative OLED display REF was maintained at about 98.91% when the data signal corresponds to the 203 grayscale. Luminance of the comparative OLED display REF was maintained at about 98.56% when the data signal corresponds to the 255 grayscale. In some embodiments, an experimental OLED display EXP changes the second voltage level of the second power voltage ELVSS within the range between about −3.1V and about −3.5V and the second voltage level is increased or decreased by about 0.1V every frame period. Luminance of the experimental OLED display EXP was maintained at about 100% when the data signal corresponds to the 51 grayscale. Luminance of the experimental OLED display EXP was maintained at about 99.77% when the data signal corresponds to the 87 grayscale. Luminance of the experimental OLED display EXP was maintained at about 99.65% when the data signal corresponds to the 151 grayscale. Luminance of the experimental OLED display EXP was maintained at about 99.57% when the data signal corresponds to the 203 grayscale. Luminance of the experimental OLED display EXP was maintained at about 98.99% when the data signal corresponds to the 255 grayscale. Thus, the experimental OLED display EXP reduced the luminance degradation by about 0.7% in comparison with the comparative OLED display REF. It is a significant effect for reducing deterioration of the OLED and the occurrence of afterimage because it is difficult to improve the characteristic of the OLED.

Therefore, the OLED display substantially periodically changes the second voltage level of the second power voltage ELVSS, thereby reducing loads of the OLED and preventing the deterioration of the OLED. The OLED display reduces the occurrence of afterimage and has a long life span.

Figure 7:
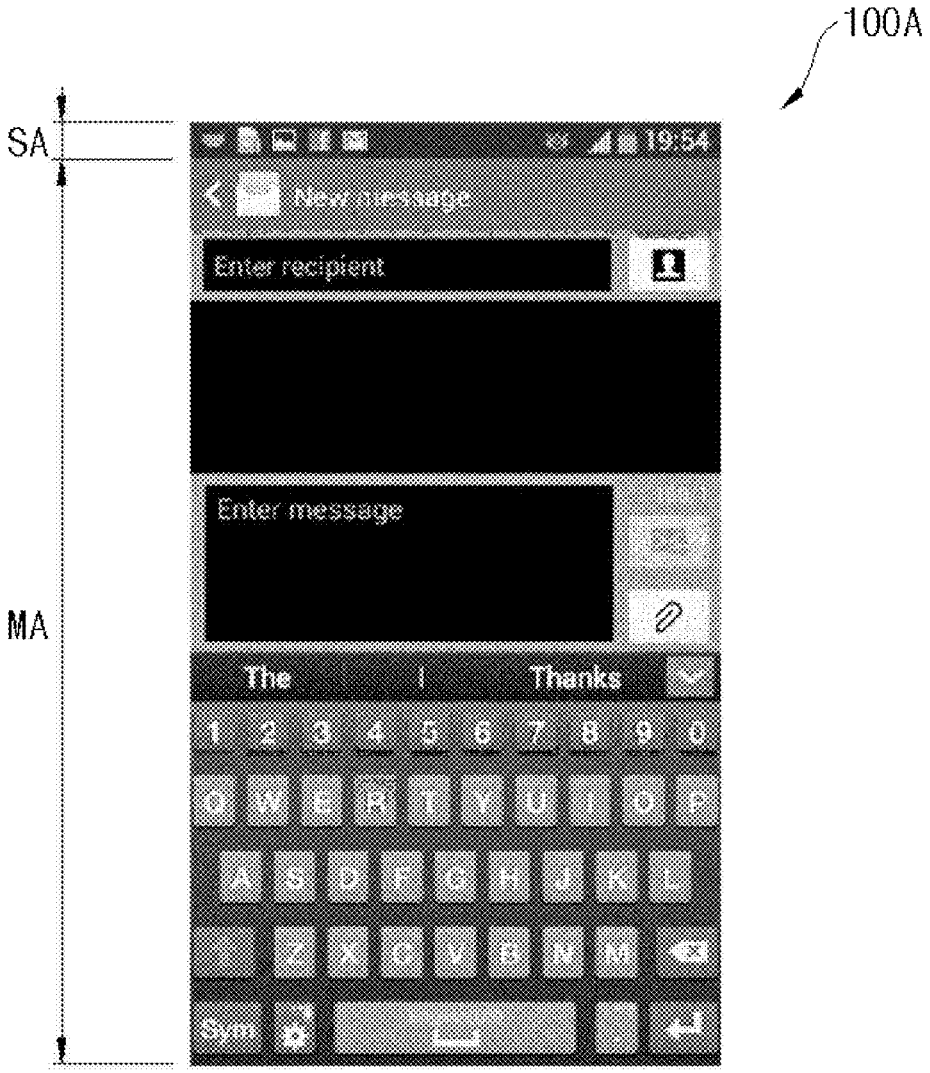
FIG. 7 is a diagram illustrating an example of a display panel included in the OLED display of FIG. 1.
Figure 8:
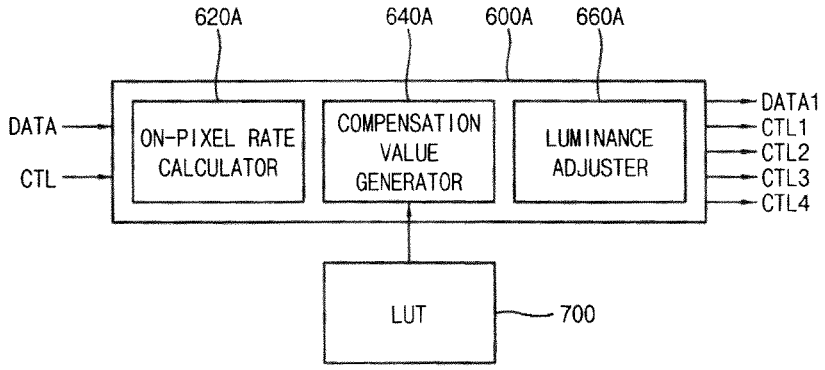
FIG. 8 is a block diagram illustrating one example of a controller included in the OLED display of FIG. 1.

FIG. 7 is a diagram illustrating an example of a display panel included in the OLED display 1000 of FIG. 1. FIG. 8 is a block diagram illustrating one example of a controller included in an OLED display of FIG. 1.

Referring to FIGS. 7 and 8, the OLED display includes the controller 600A adjusting luminance of a status display region SA based at least in part on luminance of a main display region MA, thereby preventing the occurrence of an afterimage and luminance degradation in the status display region SA.

As shown in FIG. 7, the display panel 100A is divided into the main display region MA and the status display region SA. For example, the main display region MA and the status display region SA are divided by a resistor included in the controller 600A.

The main display region MA can display main data of image data. The main display region MA can include any region other than the status display region SA. For example, in the OLED display included in the smartphone, the main display region MA displays the main data of various applications such as a web browser, a short message service (SMS), a multimedia messaging service MMS, etc.

The status display region SA can display subsidiary data of image data such as status information of the display device. For example, in the OLED display included in the smartphone, the status display region SA displays a status bar including the status data of the smartphone such as current time, antenna signal level, remaining battery capacity, notification message, etc. The status display region SA can display the still image for a long time in comparison with the main display region MA. Therefore, the occurrence of an afterimage and luminance degradation can relatively easily occur in the status display region SA in comparison with the main display region MA.

As shown in FIG. 8, the controller 600A includes an on-pixel rate calculator 620A, a compensation value generator 640A, and a luminance adjuster 660A. The controller 600A can receive an input control signal CTL and an input image data DATA from an image source such as external graphic device. The controller 600A can generate an output image data DATA1 and a plurality of timing control signals CTL1 through CTL4.

The on-pixel rate calculator 620A can calculate a first on-pixel rate of the main display region MA and a second on-pixel rate of the status display region SA. The first on-pixel rate of the main display region MA and the second on-pixel rate of the status display region SA can be calculated according to EQUATION 1 below:

$$OPR=Rd*Rg+Gd*Gg+Bd*Bg \quad \text{EQUATION 1}$$

where, OPR is the first or second on-pixel rate, Rd, Gd, and Bd respectively corresponding to red, green and blue color average grayscale data included in the input image data. Rg, Gg, and Bg respectively correspond to gain values of the red, green and blue color.

Here, the red color average grayscale data can be calculated by dividing sum of the grayscale of the red color pixels by a count of the red color pixels. Also, the green color average grayscale data and the blue color average grayscale data can be calculated in the same way as the red color average grayscale data. The gain values of the red, green and blue color are ratios of contribution to luminance of the pixel. For example, the gain value of the red color is 0.2, the gain value of the green color is 0.7, and the gain value of the blue color is 0.1.

The compensation value generator 640A can generate a compensation value for the second on-pixel rate based at least in part on a change of the first on-pixel rate. The compensation value generator 640A can generate the compensation value for the second on-pixel rate using a look-up table (LUT) 700.

In some embodiments, the LUT 700 is generated using a ratio of the second on-pixel rate to the first on-pixel rate. Thus, the LUT 700 can be configured for constantly maintaining the ratio of the luminance of the status display region SA to the luminance of the main display region MA. For example, the LUT 700 is configured such that the ratio of the luminance of the status display region SA to the luminance of the main display region MA is about 1:0.82 like in TABLE 1:

TABLE 1

| | | | | | | | | | | |
|---|---|---|---|---|---|---|---|---|---|---|
| OPR1 | 255 | 243 | 230 | 217 | 202 | 186 | 168 | 148 | 123 | 90 |
| OPR2 | 210 | 200 | 190 | 179 | 166 | 153 | 138 | 121 | 101 | 74 |

where, OPR1 is the first on-pixel rate and OPR2 is the second first on-pixel rate.

In some embodiments, the LUT 700 is configured such that the first on-pixel rate is divided into a plurality of sections, and the second on-pixel rate for each section is set like in TABLE 2.

TABLE 2

| | OPR1 | | | | |
|---|---|---|---|---|---|
| | 255~200 | 199~150 | 149~100 | 99~50 | 50~0 |
| OPR2 | 200 | 150 | 100 | 50 | 40 |

where, OPR1 is the first on-pixel rate and OPR2 is the second first on-pixel rate.

The luminance adjuster 660A can adjust the luminance of the status display region SA based at least in part on the compensation value. Thus, the luminance adjuster 660A can control at least one selected among the data driver, the emission driver, and power supply to prevent change of luminance by changing the second voltage level. In some embodiments, the luminance adjuster 660A controls the data driver to adjust the data signal based at least in part on the compensation value. In some embodiments, the luminance adjuster 660A controls the emission driver to adjust an on-period length of the emission signal based at least in part on the compensation value. In some embodiments, the luminance adjuster 660A controls the power supply to adjust the third voltage level of the initialization voltage based at least in part on the compensation value. The methods of preventing change of luminance are described above and duplicated descriptions will be omitted.

Figure 9:
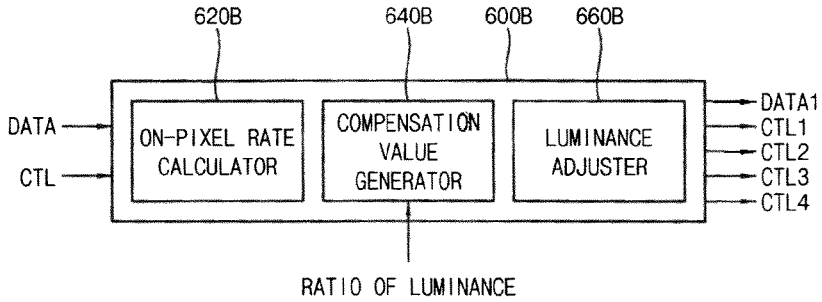
FIG. 9 is a block diagram illustrating another example of a controller included in the OLED display of FIG. 1.

FIG. 9 is a block diagram illustrating another example of the controller 600 included in the OLED display 1000 of FIG. 1.

Referring to FIG. 9, a controller 600B includes an on-pixel rate calculator 620B, a compensation value generator 640B, and a luminance adjuster 660B. The controller 600B according to the present exemplary embodiment is substantially the same as the controller 600A in FIG. 8, except for operations of the compensation value generator 640B. Therefore, the same reference numerals will be used to refer to the same or like parts as those described in the previous exemplary embodiment of FIG. 8, and any repetitive explanation concerning the above elements will be omitted.

The on-pixel rate calculator 620B can calculate a first on-pixel rate of the main display region and a second on-pixel rate of the status display region.

The compensation value generator 640B can generate a compensation value for the second on-pixel rate based at least in part on a change of the first on-pixel rate. The compensation value generator 640B can generate the compensation value for the second on-pixel rate using a predetermined ratio of the luminance of the status display region to the luminance of the main display region. For example, the second on-pixel rate can be calculated according to EQUATION 2 below:

$$OPR2=OPR1*RL \quad \text{EQUATION 2}$$

where, OPR2 is the second on-pixel rate, OPR1 is the first on-pixel rate, and RL is the ratio of luminance of the status display region SA to luminance of the main display region MA.

The ratio of the luminance of the status display region SA to the luminance of the main display region MA can be set by the user.

The luminance adjuster 660B can adjust the luminance of the status display region SA based at least in part on the compensation value.

Therefore, the OLED display can adjust luminance of a status display region SA based at least in part on luminance of a main display region MA, thereby preventing the occurrence of an afterimage in the status display region SA.

The present inventive concept can be applied to an electronic device having the OLED display. For example, the described technology is applied to cellular phones, smartphones, smart pads, personal digital assistants (PDAs), etc.

The foregoing is illustrative of example embodiments and is not to be construed as limiting thereof. Although a few example embodiments have been described, those skilled in the art will readily appreciate that many modifications are possible in the example embodiments without materially departing from the novel teachings and advantages of the inventive technology. Accordingly, all such modifications are intended to be included within the scope of the present inventive concept as defined in the claims. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims.

What is claimed is:

1. An organic light-emitting diode (OLED) display, comprising:

a display panel including a plurality of pixels;

a scan driver configured to provide a scan signal to the pixels;

a data driver configured to provide a data signal to the pixels;

a power supply configured to provide first and second power voltages, respectively having first and second voltage levels, to the pixels, wherein the power supply is further configured to periodically change the second voltage level, and wherein the second voltage level is less than the first voltage level; and a controller configured to control at least one of the scan driver, the data driver, and the power supply, wherein the power supply is further configured to provide an initialization voltage having a predetermined third voltage level to the pixels, wherein each cycle of the periodically change includes a first period and a second period, wherein the second voltage level increases from a first level to a second level during the first period and decreases from the second level to the first level during the second period, wherein the first level is less than the third voltage level, and wherein the second level is greater than the third voltage level.

2. The display of claim 1, further comprising an emission driver configured to provide an emission signal to the pixels, wherein the controller is further configured to control the emission driver to adjust an on-period length of the emission signal based at least in part on the second voltage level.

3. The display of claim 1, wherein the controller is further configured to control the data driver to adjust the data signal based at least in part on the second voltage level.

4. The display of claim 1, wherein the controller is further configured to control the power supply to adjust the third voltage level based at least in part on the second voltage level.

5. The display of claim 1, wherein the power supply is further configured to change the second voltage level to be within a range between a first reference voltage level and an (N)th reference voltage level, wherein N is an integer greater than 1, wherein an (M)th reference voltage level is greater than an (M−1)th reference voltage level, wherein M is an index variable of N, and wherein M is an integer between 2 and N.

6. The display of claim 5, wherein the first through (N)th reference voltage levels have substantially the same time length in the first and second periods.

7. The display of claim 5, wherein at least two of the first through (N)th reference voltage levels have a different time length from each other in the first and second periods.

8. The display of claim 5, wherein the power supply is further configured to increase the second voltage level from the first reference voltage level to the (N)th reference voltage level in the first period, and wherein the power supply is further configured to decrease the second voltage level from the (N)th reference voltage level to the first reference voltage level in the second period.

9. The display of claim 8, wherein the power supply is further configured to increase the second voltage level by a predetermined amount in the first period, and wherein the power supply is further configured to decrease the second voltage level by the predetermined amount in the second period.

10. An organic light-emitting diode (OLED) display, comprising:

a display panel including a plurality of pixels;

a scan driver configured to provide a scan signal to the pixels;

a data driver configured to provide a data signal to the pixels;

a power supply configured to provide first and second power voltages, respectively having first and second voltage levels, to the pixels, wherein the power supply is further configured to substantially periodically change the second voltage level, and wherein the second voltage level is less than the first voltage level; and a controller configured to control at least one of the scan driver, the data driver, and the power supply, wherein the display panel includes a main display region having a first luminance and a status display region having a second luminance, and wherein the controller is further configured to adjust the second luminance based at least in part on the first luminance.

11. The display of claim 10, wherein the controller includes:

an on-pixel rate calculator configured to calculate a first on-pixel rate of the main display region and a second on-pixel rate of the status display region;

a compensation value generator configured to generate a compensation value for the second on-pixel rate based at least in part on a change of the first on-pixel rate; and a luminance adjuster configured to adjust the first luminance based at least in part on the compensation value.

12. The display of claim 11, wherein the compensation value generator is further configured to generate the compensation value for the second on-pixel rate based at least in part on a look-up table (LUT).

13. The display of claim 11, wherein the compensation value generator is further configured to generate the compensation value for the second on-pixel rate based at least in part on a predetermined ratio of the second luminance to the first luminance.

14. The display of claim 11, wherein the luminance adjuster is further configured to control the data driver to adjust the data signal based at least in part on the compensation value.

15. The display of claim 11, further comprising an emission driver configured to provide an emission signal to the pixels, wherein the luminance adjuster is further configured to control the emission driver to adjust an on-period length of the emission signal based at least in part on the compensation value.

16. The display of claim 11, wherein the power supply is further configured to provide an initialization voltage having a third voltage level to the pixels, and wherein the luminance adjuster is further configured to control the power supply to adjust the third voltage level based at least in part on the compensation value.

17. An organic light-emitting diode (OLED) display, comprising:

a display panel including a plurality of pixels in a main display region having a first luminance and a status display region having a second luminance, wherein the first luminance is different from the second luminance;

a scan driver configured to provide a scan signal to the pixels;

a data driver configured to provide a data signal to the pixels;

a power supply configured to provide first and second power voltages, respectively having first and second voltage levels, to the pixels, wherein the second voltage level is less than the first voltage level; and a controller configured to i) control at least one of the scan driver, the data driver, and the power supply and ii) adjust the second luminance based at least in part on the first luminance such that the second luminance increases as the first luminance increases.

18. The display of claim 17, wherein the controller includes:

an on-pixel rate calculator configured to calculate a first on-pixel rate of the main display region and a second on-pixel rate of the status display region;

a compensation value generator configured to generate a compensation value for the second on-pixel rate based at least in part on a change of the first on-pixel rate; and a luminance adjuster configured to adjust the second luminance based at least in part on the compensation value.

19. The display of claim 18, wherein the compensation value generator is configured to generate the compensation value for the second on-pixel rate based at least in part on a look-up table (LUT).

* * * * *